US005156239A

United States Patent [19]

Ericson et al.

[11] Patent Number: 5,156,239

[45] Date of Patent: Oct. 20, 1992

[54] DISC BRAKE/LOAD WEIGHING ASSEMBLY FOR ELEVATOR DRIVE SHEAVE

[75] Inventors: Richard J. Ericson, Southington; James M. Draper, Woodstock, both of Conn.

[73] Assignee: Otis Elevator Company, Farmington, Conn.

[21] Appl. No.: 809,682

[22] Filed: Dec. 17, 1991

[51] Int. Cl.[5] ..... B66B 5/00

[52] U.S. Cl. ..... 187/73; 187/130; 187/131; 188/71.5; 177/132; 73/862.62; 73/862.621

[58] Field of Search ..... 187/20, 30, 31, 38, 187/39, 73, 74, 108, 109, 130, 131, 133; 188/71.1, 71.5, 73.31, 1.11; 177/132, 147; 73/862.32, 862.62

[56] References Cited

U.S. PATENT DOCUMENTS

| | | | |
|---|---|---|---|
| 3,120,880 | 2/1964 | Joseph | 187/20 X |
| 3,151,705 | 10/1964 | Chatham et al. | 188/765 |
| 3,323,606 | 6/1967 | Bruns et al. | 177/147 |
| 3,674,119 | 7/1972 | Worstell et al. | 187/38 X |
| 4,330,836 | 5/1982 | Donofrio et al. | 364/567 |
| 4,585,096 | 4/1986 | Bok | 188/71.5 X |
| 4,766,977 | 8/1988 | Yamasaki | 187/20 |
| 4,899,852 | 2/1990 | Salmon et al. | 187/1 R |
| 4,986,391 | 1/1991 | Salmon | 177/132 X |
| 5,010,981 | 4/1991 | Heikkinen | 187/20 |
| 5,046,584 | 9/1991 | Yoo et al. | 177/147 X |
| 5,067,593 | 11/1991 | Tanaka et al. | 187/73 |

*Primary Examiner*—Robert P. Olszewski
*Assistant Examiner*—Dean A. Reichard
*Attorney, Agent, or Firm*—William W. Jones

[57] ABSTRACT

Movement of an elevator cab drive sheave is controlled by a disc brake/load weighing assembly which is operably connected to the output shaft and sheave of the elevator drive machine. The disc brake assembly acts as the operating brake for normal operation of the elevator, and can also serve as an upward or downward safety brake. The brake assembly can be retrofitted onto an existing elevator system, and its operation is not affected by any gear degradation in the machine drive gears. The brake when it is set acts to impart movement to a torque arm which is operably connected to a load cell mounted on the machine bedplate. The load imparted to the load cell is proportional to the weight of the cab and its occupants. The load cell is connected to the elevator controller and imparts a load signal to the controller each time the cab stops.

6 Claims, 5 Drawing Sheets

DISC BRAKE/LOAD WEIGHING ASSEMBLY FOR ELEVATOR DRIVE SHEAVE

TECHNICAL FIELD

This invention relates to a cab load weighing assembly for an elevator, and more particularly to a load weighing assembly that operates in concert with a disc brake assembly which provides both up and down emergency brake utility, as well as normal operating brake utility.

BACKGROUND ART

An important input for an elevator controller relates to the load, or number of passengers, in the elevator car. U.S Pat. No. 4,330,836 granted May 18, 1982 to A. J. Donofrio, et al., relates to elevator cab load measuring, and contains a discussion of the desirability of monitoring car load, and the enhancement of elevator control derived therefrom. In the system disclosed in this patent, the elevator car is mounted on the frame by means of a plurality of elastomeric damped mount assemblies. There are, for example, six of the mount assemblies, and two of them will be equipped with force transducers which measure the car load.

U.S. Pat. No. 4,899,852 granted Feb. 13, 1990, to us discloses an elevator car mounting assembly wherein the car is suspended on the frame by a plurality of pendulum rods, one at each corner of the car. This patent briefly alludes to a load weighing assembly which is included in the mounting assembly.

U.S. Pat. No. 3,323,606 granted Jun. 6, 1967 to W. J. Bruns, et al., discloses an elevator load weighing apparatus which is installed in the machine room of the building housing the elevator. The elevator rope drive and sheave assembly are mounted on a bedplate in the machine room. The bedplate is mounted for pivotal movement about substantially its vertical mid plane, and one side of the bedplate is connected to a pressure transducer which measures the pivotal movement of the bedplate, which is proportional to the load in the elevator cab. Load weighing of the cab is thus performed in the machine room of the elevator system. The load weighing system of the aforesaid Bruns, et al., patent requires a complex machine mounting assembly and is not readily amenable to retrofitting to existing equipment in service in the field.

U.S. Pat. No. 4,766,977 granted Aug. 30, 1988 to S. Yamasaki discloses a load weighing apparatus for an elevator which detects cab load by measuring the traction sheave shaft torque with magneto-strictive material which is mounted on the sheave shaft between the sheave and gear or brake. The magnetic permeability of the material varies with torsional stress and thus is indicative of the torque on the machine and thus the load in the cab. This type of apparatus involves the use of a specially formulated material positioned on the output shaft, and is not readily retrofittable onto existing equipment in the field.

DISCLOSURE OF THE INVENTION

This invention relates to a multi-disc disc brake assembly which can be retrofitted onto elevator equipment in the field and which acts in concert with an elevator cab load weighing device. The brake assembly is operably mounted on the sheave/output side of the machine drive shaft. The rotating discs in the brake assembly are mounted on a tapered extension which is bolted and pinned to the output shaft for rotation therewith. The stationary portion of the brake assembly carries a torque arm which is operably connected to the machine bedplate. The torque arm is operably connected to a load measuring cell which measures cab load as a function of forces imparted to the torque arm when the brake is set stopping the cab.

The geometry of the brake assembly allows the use of large brake discs, i.e., fifteen to twenty inch diameter discs, for example, which provide a large magnetic path so that high braking torque can be developed at low operating power. The large magnetic path reduces or eliminates magnetic saturation in the non-rotating metal brake discs which in turn allows a relatively large brake-actuating spring force to be used in the brake. By way of example, the brake of this invention can develop 3,800 to 6,000 ft. lbs. of torque using less than one amp of current. By coupling the brake assembly and torque arm with the load cell, cab load weighing can be performed each time the brake is set. The load cell is operably connected to the elevator controller to transmit load information to the controller.

It is therefore an object of this invention to provide a brake assembly for an elevator system which is coupled with a load cell for performing cable load weighing measurements when the brake is set. For geared or gearless elevators suspended on steel cables, a counterweight is necessary to supply adequate traction and tension in the cables. The load cell provides a direct measurement of the load in the elevator car, since the force on the brake torque arm is linearly proportional to the car imbalance load for a counterweighted elevator.

It is a further object of this invention to provide a brake assembly with load weighing of the character described which acts on the output side of the machine output shaft.

It is another object of this invention to provide a brake and load cell assembly of the character described which can be retrofitted onto existing equipment in the field.

These and other objects and advantages of this invention will become more readily apparent from the following detailed description of a preferred embodiment thereof when taken in conjunction with the accompanying drawings, in which:

BEST MODE FOR CARRYING OUT THE INVENTION

Figure 1:
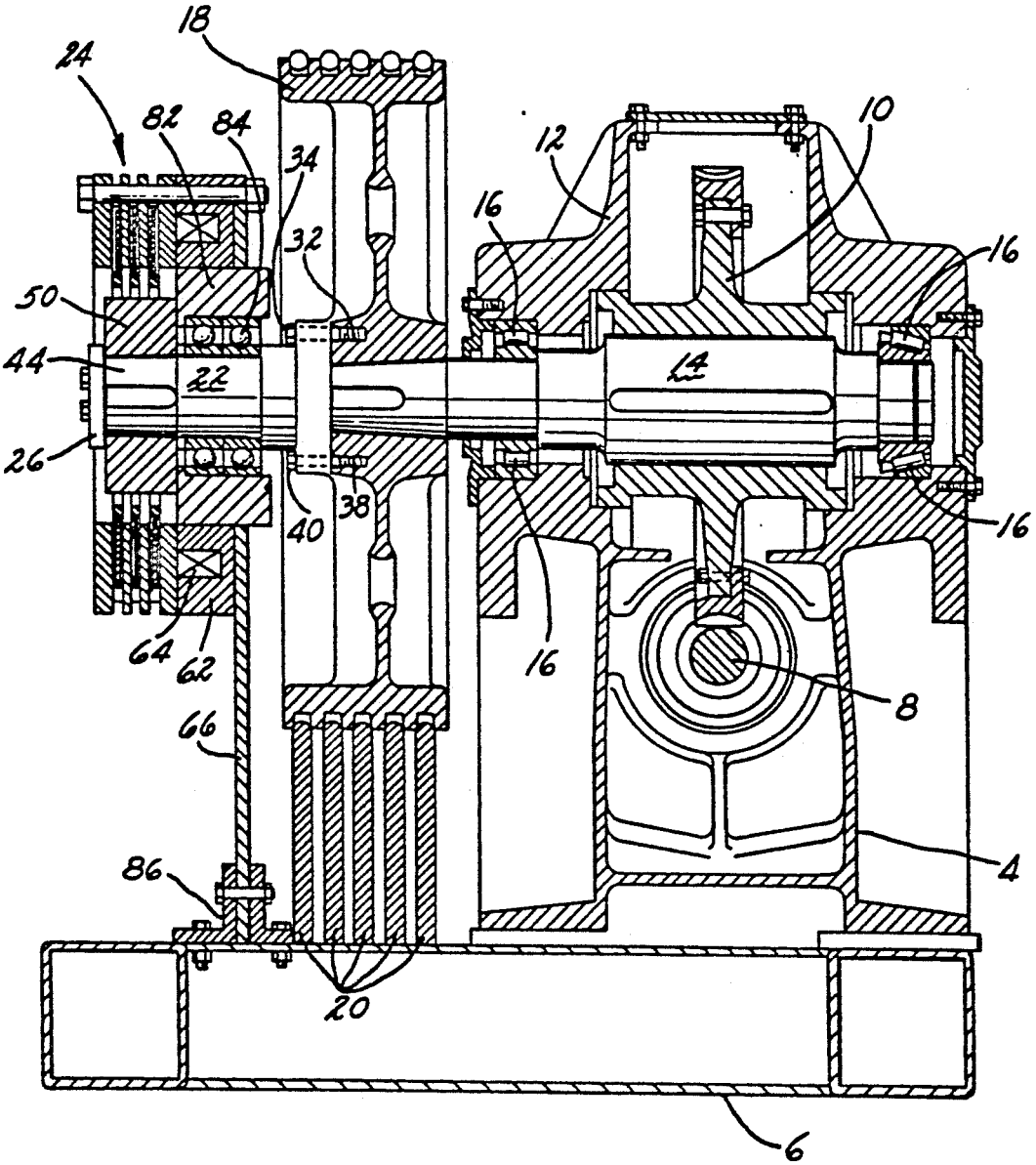
FIG. 1 is a cross-sectional view of a geared elevator machine having a preferred embodiment of a safety brake thereon which is formed in accordance with this invention.

Referring now to FIG. 1, there is shown a preferred embodiment of a retrofitted multiple disc emergency brake mounted on a conventional geared elevator drive machine. The machine is denoted generally by the numeral 2 and includes a lower casing 4 which is mounted on a bedplate 6 in the machine room of the building housing the elevator. The lower casing 4 houses a worm gear 8 which meshes with a ring gear 10 mounted in an upper casing 12 of the machine 2. It will be understood that the worm gear 8 is driven by an electric motor (not shown) and in turn drives the ring gear 10. The ring gear 10 is keyed to an output shaft 14 which is journaled in bearings 16 in the upper casing 12. The elevator drive sheave 18 is mounted on and keyed to the output shaft 14 and carries the elevator cab and counterweight cables 20. The components described to this point constitute the conventional general components of a geared elevator drive assembly. It is such an assembly that is modified as follows to provide an operating braking feature.

An output shaft extension 22 is mounted on the output shaft 14 and the sheave 18 to form a rotating extension thereof. A multiple disc brake assembly denoted generally by the numeral 24 is mounted on the output shaft extension 22. The conventional cover plate 26 is mounted on the end of the output shaft extension 22 to hold the brake assembly 24 in place on the extension 22.

Figure 2:
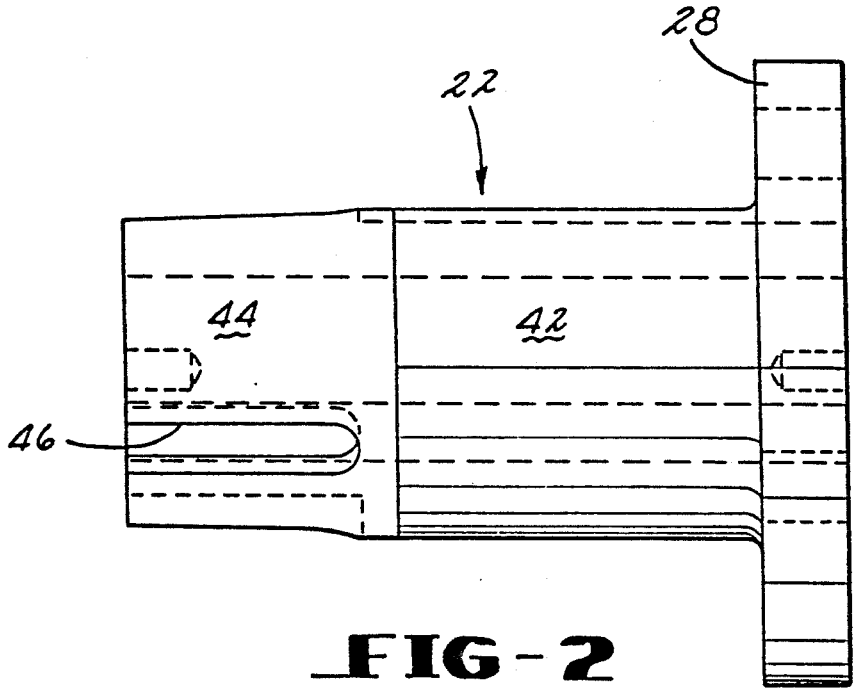
FIG. 2 is a side view of the output shaft extension portion of the brake assembly.
Figure 3:
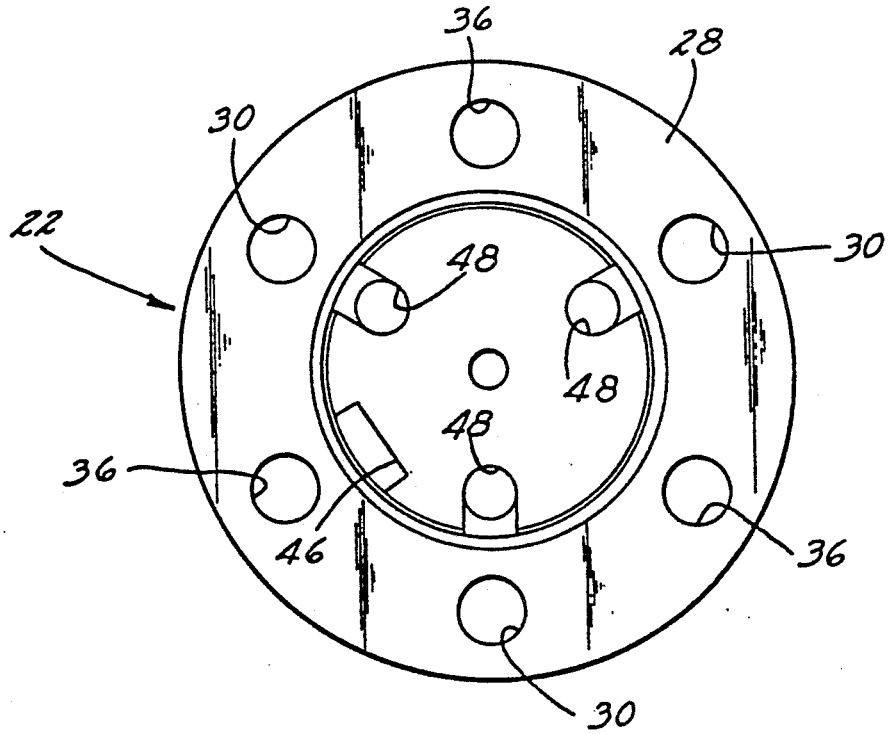
FIG. 3 is an end elevational view of the shaft extension as seen from the left hand side of FIG. 2.

Referring to FIGS. 2 and 3, details of the output shaft extension 22 are shown. The extension 22 has an end flange 28 which faces the end of the output shaft 14 and the side of the sheave 18. The flange 28 has three holes 30 which align with existing threaded holes 32 in the sheave 18 (see FIG. 1). The existing holes 32 are normally used to mount an hydraulic pulling jack on the sheave 18 when it is necessary to remove the sheave 18 from the output shaft 14 for servicing. Bolts 34 (see FIG. 1) are passed through the holes 30 and screwed into the tapered sheave holes 32 to form a first securement of the extension 22 to the sheave 18. The flange 28 also has a second set of equispaced holes 36 which face the sheave 18 after the extension 22 is bolted thereto. The second set of flange holes 36 are then used as pilots for drilling matching holes 38 in the sheave 18 (see FIG. 1). Securement pins 40 are then pressed into the aligned holes 36, 38 to form a secondary connection between the extension 22 and the sheave 18. There are thus six torque transmitting connections between the extension flange 28 and the sheave 18.

Projecting from the flange 28 is a cylindrical boss 42 which terminates in a tapered nose 44. A key slot 46 is formed in the nose 44 for keying a part of the brake assembly to the extension 22, as will be explained in greater detail hereinafter. There are three equispaced through passages 48 drilled through the boss 42 and nose 44. These passages 48 are aligned with standard tapped holes in the end of the output shaft 14 which normally receive bolts used to secure the cover plate 26 to the end of the output shaft 14 in a standard machine that has not been fitted with the brake of this invention. Appropriately sized bolts are passed through the cover plate 26 and the passages 48 and are screwed into the preexisting tapped holes in the output shaft 14. In this manner a direct connection between the extension 22 and the output shaft 14 is made. It will be noted that there are in all nine connections between the extension 22 and the sheave/output shaft combination. This ensures safe transmittal of torque between the respective parts of the drive and brake assembly.

Figure 5:
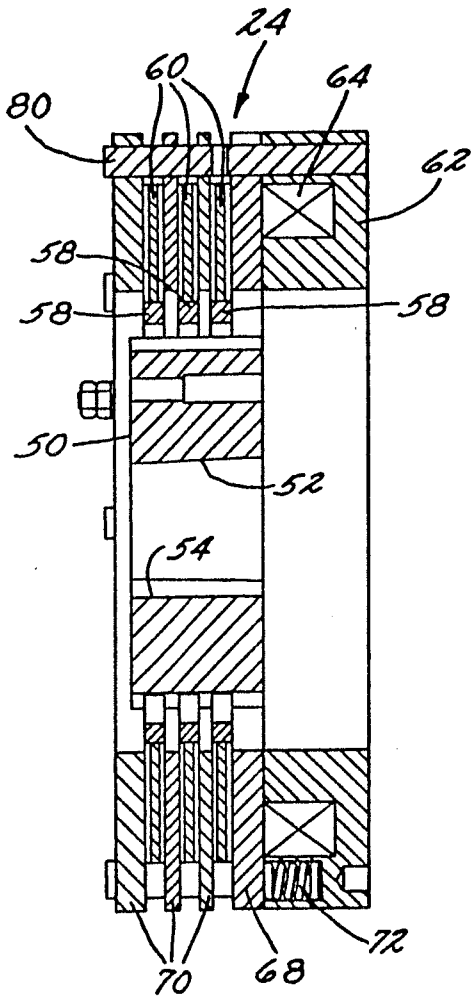
FIG. 5 is a sectional view of the disc assembly taken along line 5—5 of FIG. 4.
Figure 4:
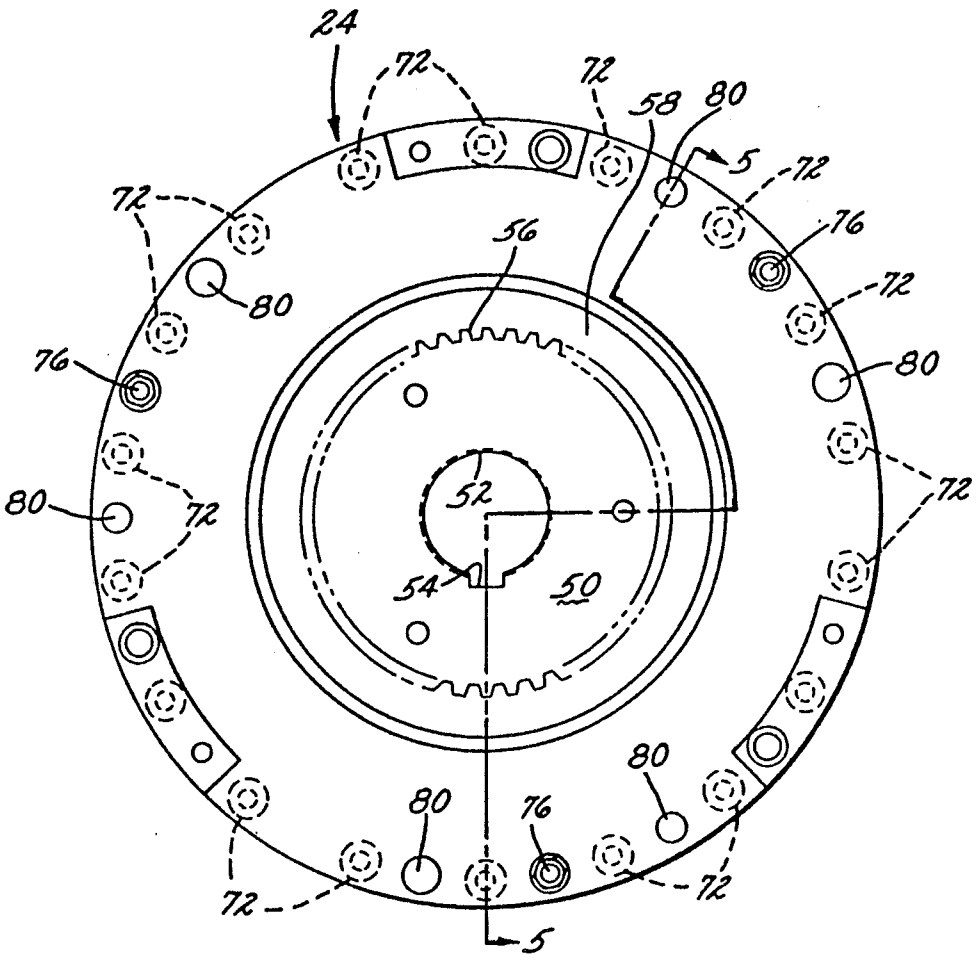
FIG. 4 is an end view of the multiple disc brake assembly as seen from the left hand side of FIG. 1.

Referring now to FIGS. 1, 4 and 5, details of the brake assembly 24 are shown. As most clearly shown in FIGS. 4 and 5, the brake assembly 24 includes a central hub 50 which has a through tapered passage 52 with a key slot 54. The hub 50 is fitted onto the extension nose 44 and keyed thereto for rotation therewith. It will be noted from FIG. 1 that the plate 26 jams the hub 50 on the extension nose 44. Referring back to FIG. 4, the outer circumferential surface of the hub 50 is formed with splines 56 so as to be fitted with a plurality of internally splined friction discs 58 of a suitable number, depending on the amount of braking torque which is required in each application. Each of the discs 58 carries an annular radially outwardly extending friction pad 60. It will be appreciated from the above, that the hub 50, discs 58 and pads 60 all rotate with the output shaft 14 and sheave 18.

The brake assembly 24 also includes a magnet assembly 62 having a coil 64, and which is mounted on a torque arm 66 (See FIG. 1). An armature plate 68 is disposed adjacent to the magnet assembly 62, followed by a series of annular brake plates 70. It will be noted that the friction discs 60 and brake plates 70 are interleaved. The armature plate 68 is biased away from the magnet assembly 62 by a plurality of coil springs 72, and the brake plates 70 are biased apart by a plurality of light coil springs 74 mounted on bolts 76 which extend through the armature plate 68 and the brake plates 70. The brake plates 70 are thus held away from the interleaving friction discs 60 by the coil springs 74 when the brake assembly is "off". Nuts 78 are threaded onto the ends of the bolts 76 to allow for adjustment of the spacing between the plates 70 to account for wear on the brake during its useful life. A plurality of guide dowels 80 dispersed circumferentially about the brake assembly 24 extend through the magnet assembly 62, and the armature plate 68 and brake plates 70 to guide axial movement of these components relative to each other when the brake is set and released.

Figure 8:
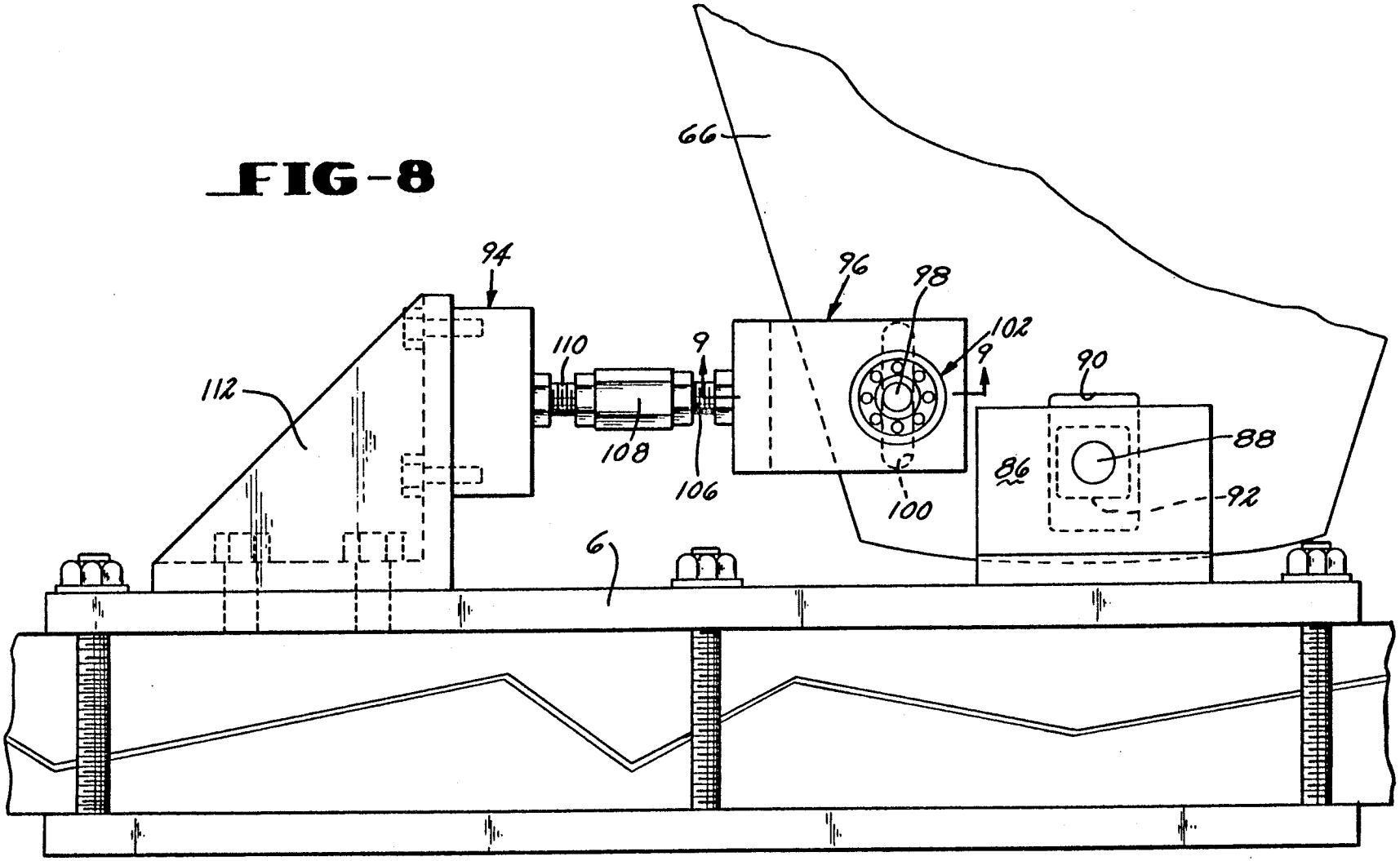
FIG. 8 is a fragmented side elevational view of the torque arm-load cell-machine bedplate interconnection portions of the brake assembly.

Referring back to FIG. 1, it will be noted that the magnet assembly 62 is mounted on a sleeve 82 which in turn is mounted on the outer race of a ball bearing 84 assembly. The sleeve 82 passes through and is fixed to the torque arm 66. It will be appreciated from the above that the discs 60 rotate with the output shaft 14 and sheave 18, while the plates 70 remain relatively stationary. The torque arm 66 is connected to the bedplate 6 by means of a clevis 86 bolted to the bedplate 6, and a transverse pin 88 which passes through the torque arm 66 and clevis 86. FIG. 8 shows details of the connection between the torque arm 66, load cell 94, and bedplate 6. The torque arm 66 has a rectangular opening 90 cut therein through which the pin 88 passes. A hardened steel plaque 92 is mounted on the pin 88 and positioned within the torque arm opening 90. The plaque 92 is smaller than the opening 90 so that the torque arm 66 can undergo limited movement at its lower end within the clevis 86. The plaque also allows the use of a thin cross sectional torque arm (approximately ¼"), because it limits the Hertzian contact stress that would otherwise be present if a larger round pin were applied to a round hole in the torque arm. This limited movement will allow for a normal degree of wobble of the output shaft extension 22 without interfering with normal operation of the drive, and also allow for all of the brake torque reaction to be applied to the load cell.

Figure 9:
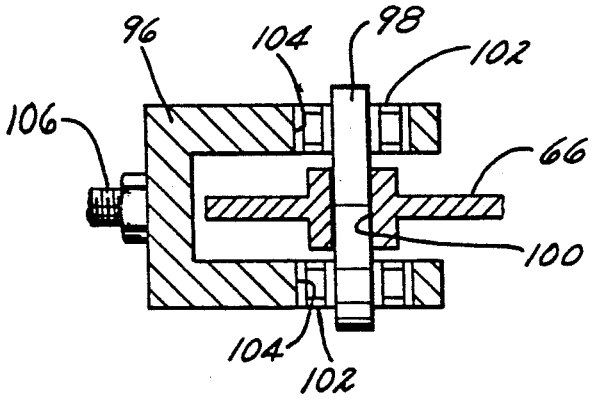
FIG. 9 is a horizontal sectional view taken along line 9—9 of FIG. 8.
Figure 6:
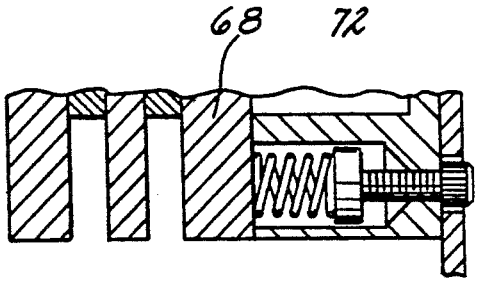
FIG. 6 is a fragmented sectional view of one of the brake actuating springs in the brake assembly.
Figure 7:
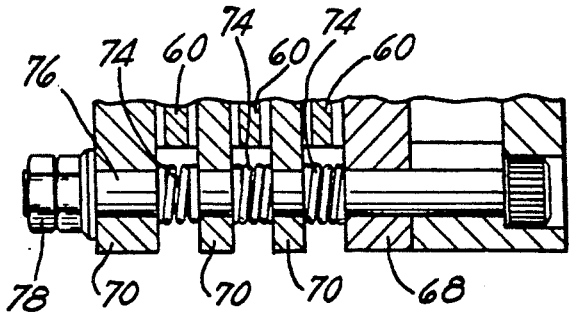
FIG. 7 is a fragmented sectional view of one of the brake plate adjustment bolts in the brake assembly.

Referring to FIGS. 8 and 9, a clevis 96 is mounted on a pin 98 which extends through a slot 100 in the torque arm 66. The pin 98 is journaled in roller bearing assemblies 102 staked into openings 104 on the clevis 96. A threaded bolt 106 is mounted on the clevis 96 and is connected by a turn buckle 108 to a threaded fitting 110 on the load cell 94. The load cell 94 is mounted on a bracket 112 secured to the bedplate 6. It should be noted that the load cell is a bi-directional force transducer, so that both positive and negative torques can be measured equally well, and with a high degree of accuracy.

The brake/load weighing assembly described above operates as follows. During movement of the elevator cab, the coil 64 is energized, and the armature plate 68 is magnetically held against the magnet assembly 62 causing the actuating springs 72 to be compressed. The brake assembly 24 is thus in a "release" mode, and the friction discs 60 will be free to rotate with the extension 22, uninhibited by the plates 70. In the event of a stop of the cab at a landing, power to the coil 64 will be switched off, and the coil 64 will deenergize. The actuating springs 72 will then move the armature plate 68 away from the magnet assembly 62 and toward the annular brake plates 70. The force of the springs 72 is such that the spacer springs 74 will be compressed and the plates 70 will clamp the discs 60 against further movement. This will move the torque arm 66 in the clevis 86. Such movement will create a positive or negative pressure on the load cell 94 though the connection 106, 108, 110 which will be proportional to the weight of the cab and its occupants. The loading of the cab will thus be accurately detected each time the cab stops at a landing.

It will be readily appreciated that the brake/load weighing assembly of this invention can be retrofitted onto an existing elevator in the field, and can be easily connected to the elevator controller. The brake assembly of this invention can generate high torque braking forces without damaging components of the elevator drive, and can be operated with a very small current power supply. The loose fitting between the torque arm and bedplate allows for normal wobble of the brake assembly on the sheave, and relaxes installation parameters. While the brake assembly can be used as the normal cab holding brake when the cab is stopped at landings to allow normal passenger traffic between the cab and landings, it could also be operably connected to the governor rope system and landing sensors in the elevator so as to serve as a safety brake for stopping unsafe elevator cab movement. Likewise, it will be readily apparent that the brake assembly's utility is not limited to geared elevator machines, but can also be used in conjunction with a gearless elevator system.

Since many changes and variations of the preferred embodiment of this invention may be made without departing from the inventive concept, it is not intended to limit the invention otherwise than a required by the appended claims.

What is claimed is:

1. In combination with an elevator drive system which includes a drive machine having an output shaft and a sheave mounted on said output shaft, a plurality of hoist cables reeved over the sheave, and wherein the drive machine is fixed to a bedplate, a brake/load weighing assembly comprising:

a) friction disc means operably connected to and rotatable with said output shaft and sheave;

b) brake plate means fixed against rotation relative to said output shaft, said friction disc means being interposed between components of said brake plate means;

c) actuating means for selectively causing said brake plate means to clamp said friction disc means against rotation thereby selectively stopping rotation of said output shaft and sheave;

d) a load cell associated with said drive system and fixed against movement relative to said bedplate; and e) means operably connected to said brake plate means and to said load cell for transmitting brake torque-proportional loads to said load cell, which loads are generated when said friction disc means is clamped against rotation.

2. The combination of claim 1 wherein said load cell is mounted o said bedplate.

3. The combination of claim 2 wherein said load cell is a bi-directional force transducer operable to produce load signals responsive to clamping of said friction disc means in both directions of rotation of said output shaft and sheave.

4. The combination of claim 3 wherein said means for transmitting is a plate-shaped torque arm movably mounted on a clevis secured to said bedplate.

5. In combination with an elevator drive system which includes a drive machine having an output shaft and a sheave mounted on said output shaft, a plurality of hoist cables reeved over the sheave, and wherein the drive machine is fixed to a bedplate, a brake/load weighing assembly comprising:

a) friction disc means operably connected to and rotatable with said output shaft and sheave;

b) brake plate means fixed against rotation relative to said output shaft, said friction disc means being interposed between components of said brake plate means;

c) actuating means for selectively causing said brake plate means to clamp said friction disc means against rotation thereby selectively stopping rotation of said output shaft and sheave;

d) a bi-directional load cell associated with said drive system and fixed against movement on said bedplate; and e) torque arm means operably connected to said brake plate means and to said load cell for transmitting brake torque-proportional loads to said load cell, which loads are generated when said friction disc means is clamped against rotation.

6. The combination of claim 5 wherein said torque arm means is plate-shaped and is movably mounted on a bracket secured to said bedplate.

* * * * *